US008573506B2

(12) United States Patent
Nogret

(10) Patent No.: US 8,573,506 B2
(45) Date of Patent: Nov. 5, 2013

(54) EXPANSION DEVICE FOR A GUIDE RAIL

(75) Inventor: Marc Nogret, Lambersart (FR)

(73) Assignee: Siemens SAS, St. Denis (FR)

( * ) Notice: Subject to any disclaimer, the term of this patent is extended or adjusted under 35 U.S.C. 154(b) by 44 days.

(21) Appl. No.: 13/059,198

(22) PCT Filed: Aug. 15, 2008

(86) PCT No.: PCT/FR2008/001197
§ 371 (c)(1),
(2), (4) Date: Apr. 27, 2011

(87) PCT Pub. No.: WO2010/018310
PCT Pub. Date: Feb. 18, 2010

(65) Prior Publication Data

US 2011/0192908 A1 Aug. 11, 2011

(51) Int. Cl.
*E01B 11/42* (2006.01)

(52) U.S. Cl.
USPC ..... 238/122; 238/227; 238/228; 238/151; 238/152

(58) Field of Classification Search
USPC ..... 238/10 R, 10 A, 171, 15, 10 E, 10 F, 122, 238/151, 228, 152, 227, 173; 267/257, 153, 267/294; 104/87, 130.11, 242, 243, 244, 104/245
See application file for complete search history.

(56) References Cited

U.S. PATENT DOCUMENTS

| | | | | |
|---|---|---|---|---|
| 3,707,218 | A * | 12/1972 | Payne et al. | 198/838 |
| 5,104,101 | A * | 4/1992 | Anderson et al. | 267/219 |
| 6,398,121 | B1 | 6/2002 | Morgan | |
| 2006/0265976 | A1 * | 11/2006 | Fiutak et al. | 52/177 |

FOREIGN PATENT DOCUMENTS

| | | | |
|---|---|---|---|
| DE | 585072 | C | 9/1933 |
| DE | 19929773 | A1 | 1/2001 |
| GB | 363538 | A | 12/1931 |
| GB | 642700 | A | 9/1950 |

* cited by examiner

*Primary Examiner* — Mark Le
(74) *Attorney, Agent, or Firm* — Laurence A. Greenberg; Werner H. Stemer; Ralph E. Locher

(57) ABSTRACT

An expansion device for a rail suitable for guiding a wheel of a vehicle along a track, and a method for installing the expansion device. Specifically, the rail has a portion of track formed of a series of elements in the form of transverse track plates whose cross section is the same as that of the rail. The track plates are arranged in longitudinal succession along the portion with compressible modules inserted between them.

14 Claims, 2 Drawing Sheets

EXPANSION DEVICE FOR A GUIDE RAIL

BACKGROUND OF THE INVENTION

Field of the Invention

The present invention concerns a rail expansion device adapted to the guidance of a vehicle wheel on a track and a procedure for its installation on a section of the track.

The application of the present invention concerns the public transport domain such as trains, underground trains, tramways, trolley buses, buses, etc. and more particularly that of vehicles guided by tyres and traction vehicles with central guidance for which the path is realised by a single central metal rail between two running tracks of pneumatic tyre wheels. Concerning traction guidance, two angled rollers, rolling directly along either side of a central rail, control for example a vehicle steering system and therefore ensure a defined path of the latter.

It should be noted that the application domain of the invention also concerns one or more railway rails adapted to the guidance of an iron type carrying wheel, instead of tyres, as for standard train vehicles.

Subjected to variations in temperature, notably in elevated sections, a rail designed using steel undergoes an expansion phenomenon, in other words a relative increase in all of its dimensions. The most notable variation being its length.

Other external phenomena can add to this:

1) Either longitudinal mechanical constraints
2) Or movements relative to one section of rail in relation to another. It may be a matter of for example:
   - shrinkage/creeping and expansion specific to the structure on which the rail is fixed,
   - longitudinal movements of viaduct decks caused by mechanical constraints such as vehicle braking
   - effect of wind
   - effect of earthquakes
   - etc.

In all of the cases cited, the presence of a rail expansion device adapted to the guidance of a vehicle wheel on a track is rendered necessary to limit, or even eliminate a concentration of constraints which are detrimental to the rail. Within an elevated context, it is common to encounter structural play of 150 mm between the different portions of the viaduct for example. The purpose of the expansion device is to correct and compensate for the play or movements relating to the structures and thus enable expansion of the rail further to the constraints (thermal) whilst guaranteeing continuity of the guidance function. This therefore allows for the prevention, in particular, of significant longitudinal constraints in the rail.

Different types of expansion device currently available ensure such correction of the constraints at a single point.

This generally relates to:

- for rails on a portion of the track, the expansion device comprises two rails that may be superimposed, machined with a bevelled edge such that there is no discontinuity of the single bearing surface. The two bevelled strips slide inside the special bearings thereby inhibiting any lateral displacement of them, whilst authorizing free longitudinal displacement according to the track. The sleepers on which this device rests are connected to each other by metal parts restraining their movement.
- for beams on a portion of the track, the expansion device also comprises components which are cut with a bevelled edge. Mechanical continuity of movement being ensured by fish plating at the level of a common core of components, said fish plating being associated with oblong holes. Tightening of the bolts related to the fish plating is thus controlled precisely according to a low torque value.

On the one hand, none of these systems responds simply to the constraints of the guidance concerned. On the other hand, these devices, as a general rule, can be quite complex to produce and particularly to install given that, considering the same guidance principle, it is necessary for the safe function of the expansion device:

1. on the one hand to respect a maximum gap of 10 mm between two track components in "expanded" mode;
2. on the other hand to ensure mechanical continuity which is symmetrical in relation to the plane of the track in order that the two guide wheels are balanced (in traction) regardless of the shape of the track and the constraints to which it is subjected.

BRIEF SUMMARY OF THE INVENTION

One aim of the present invention is therefore to provide a rail expansion device adapted to the guidance of a vehicle wheel on a track, for which the design and installation must be simplified, whilst guaranteeing safe operation.

Such a device and installation process of said device are provided by the content of the independent claims.

From the expansion device of a rail adapted to the guidance of a vehicle wheel on a track, the invention anticipates that the rail comprises a portion of track composed of a series of components in the form of transverse strips of track having an identical cross-section to that of the rail, being successively and longitudinally positioned on the portion and between which compressible modules are interspersed.

In this way, it is advantageously possible to guarantee mechanical continuity by simple expansions which are successively juxtaposed between the strips, whilst ensuring continuity of wheel guidance/movement since the maximum gaps of 10 mm between the sections/strips are easily obtained by choosing compressible modules of this maximum width.

Due to this juxtaposition of strips, it is also possible to correct significant play in the structure. In other words, by means of a suitable quantity of strips, it is possible to compensate for any foreseeable length of expansion.

The use of such compressible modules which are inserted like elastic/elastomer components or a spring simultaneously enables the expansion phenomenon to be rendered extremely safe and also to better absorb rolling vibrations and therefore to reduce noise from the rail.

The simple architecture of the expansion device is thus also planned for in order to facilitate its installation as well as its maintenance/replacement.

To this end, the invention provides for an installation process for an expansion device such as previously described, according to which:

- a section of the track is released from the entire rail over a defined length,
- an assembly comprising two rail fittings capping the ends of the series of transverse strips with compressible components is inserted in place of said section.

Only the two external ends of the fittings should thus be secured simply (for example welded) to the remainder of the track for which expansion should be compensated for. No additional adjustments are necessary with regard to the installation, as expansion appropriate to a specific environment is governed by the chosen structure of a series of strips (number of strips, width/flexibility of the slits formed by the compressible modules).

A group of sub-claims also presents advantages of the invention.

Examples of embodiment and application are provided using the figures described below:

DESCRIPTION OF THE INVENTION

Figure 1:
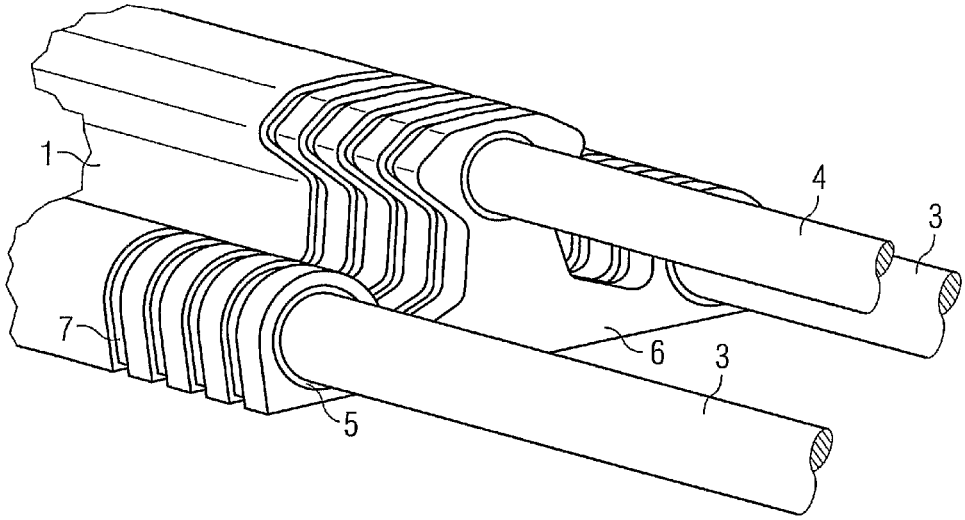
FIG. 1 a first partial view of the device according to the invention.
Figure 2:
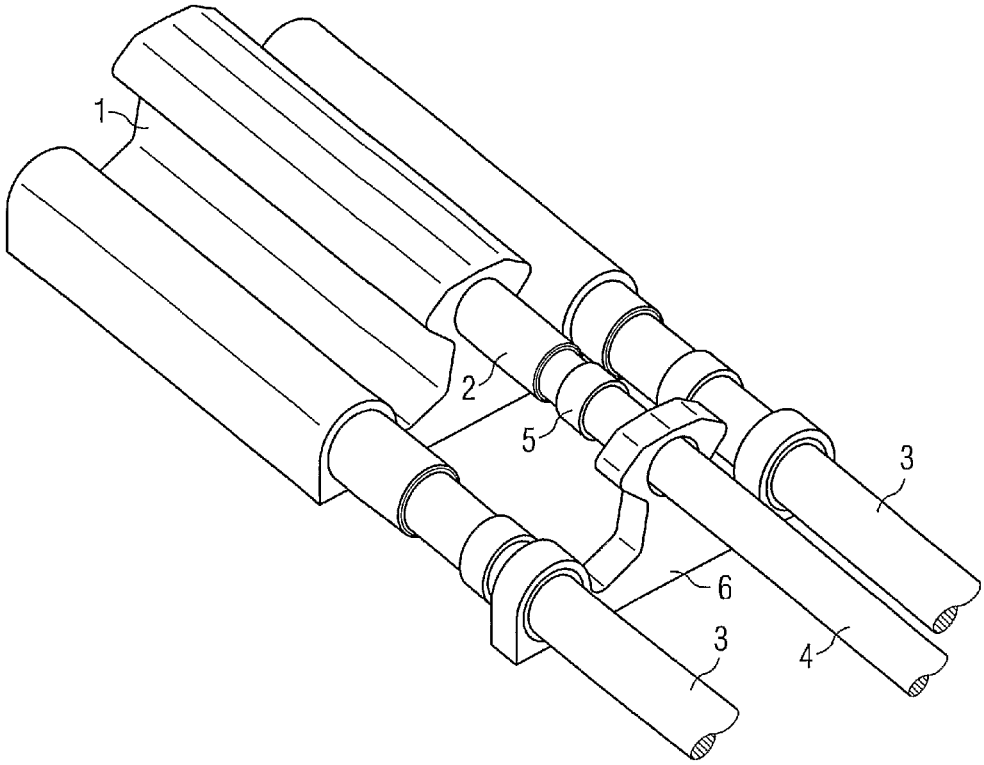
FIG. 2 a second partial view of the device according to the invention.

FIGS. 1 and 2 present a first and second partial view of the expansion device of a rail (1) adapted to the guidance of a vehicle wheel on a track according to the invention. FIG. 2, being an exploded view of FIG. 1, is designed to show the internal parts of said expansion device.

The rail susceptible to expansion on the track is thus interrupted and comprises a portion of track formed by a rail fitting (1), a series of components in the form of transverse strips (6) of track having a cross-section identical to that of the rail, being successively and longitudinally positioned on the portion and between which compressible modules are interspersed (7), only represented in FIG. 1. A second rail fitting (not represented) is also planned for at the other end of the series of transverse strips, such that the series of strips and their interspersed compressible modules are jointly capped between the two fittings.

The compressible modules (7) are for example elastomer or spring type in order to provide variable adjacent widths, ideally in rest mode (free from expansion, and therefore of compression of said modules) of approximately 10 mm. This latter order of size is particularly well adapted to the size of the current wheels for standard public transport. A series of at least 15 compressible modules therefore enables the compensation, without any difficulty, of 150 mm of expansion for rails adjacent to the device according to the invention. In practice, it also turns out that 21 strips for a compensation of 150 mm of possible expansion is a sufficiently suitable number.

The transverse strips are for example simple "sections" which are transversely cut in a rail. Said transverse strips comprise at least one opening connecting its two cross-sections and adapted to allow for the positioning of an anti-friction component (5) such as a ring inside the opening in which a shaft (3, 4) is inserted longitudinally connecting the rail which is susceptible to expansion by a slide (through the two rail fittings) to the transverse strips. The rail comprises at its fittings which are substituted and positioned at the end of the portion of track for the expansion device, at least one opening for an anti-friction component (2) in which a shaft (3, 4) is inserted longitudinally connecting the rail to the transverse strips by a slide.

Ideally, the shafts (3, 4) are three in number and are inserted on either side and in the top part of the section of a traction rail (for two traction rollers) and transverse strips.

In all cases, one or more shafts simply enable sufficient rigidity to be obtained for mechanical retention of the strips in order to ensure perfect continuity of the track. Lateral gaps in the strips in relation to the direction of the track are thus, in the event of expansion, highly advantageously eliminated.

The rail susceptible to expansion may be advantageously a railway rail adapted to the guidance of an iron type wheel. In this case, the strips can also be sections of iron type rail.

Alternatively, the rail susceptible to expansion may be a flat track adapted to the guidance of an iron or concrete type pneumatic wheel. Here again, the strips may also be sections of an iron type rail or another material of which the top part ensures continuous flatness with the rail susceptible to expansion.

Finally, the rail may be a traction rail adapted to the guidance of one or two lateral wheel(s) of the traction rail on which two traction rollers are gripped (angled at approximately 45° on one or both sides of the rail). Here again perfect continuity of track is ensured for several wheels/rollers.

Figure 3:
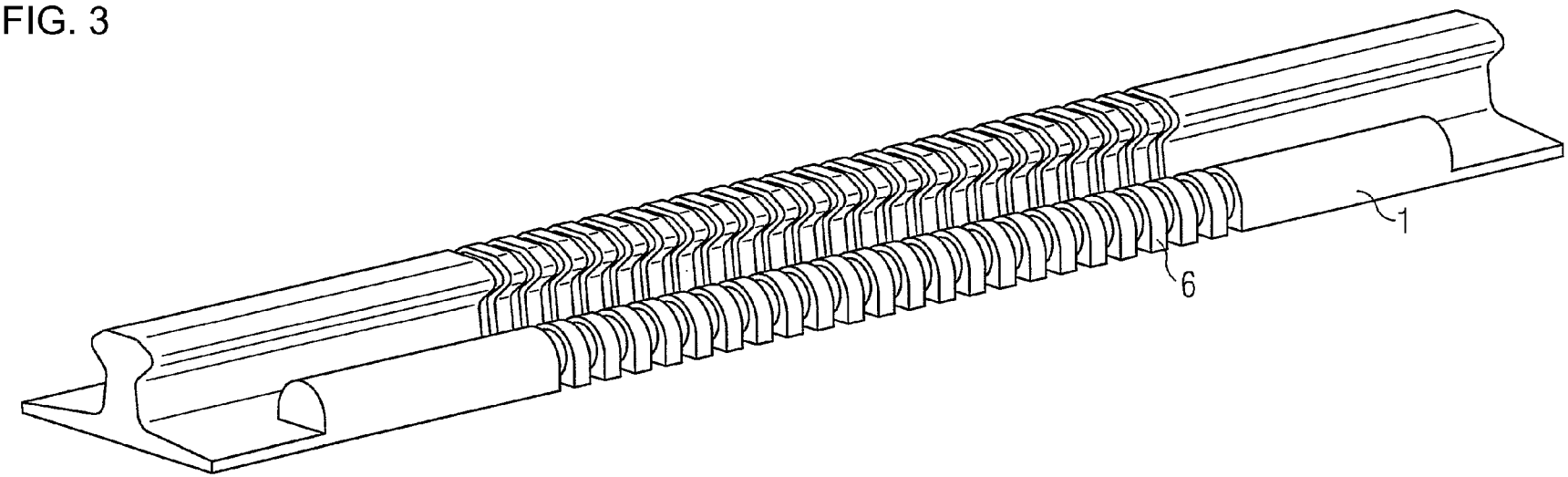
FIG. 3 a third complete view for a typical example of the device according to the invention.

FIG. 3 presents a third complete view for a typical example of the expansion device according to the invention. In a single unit assembly, two rail fittings (1) cap on either side the series of transverse strips (6) between which compressible modules are positioned. This assembly is a concrete example of an expansion device adapted to the implementation of the installation method according to the invention of this latter by simple insertion on a section of track previously removed.

The invention claimed is:

1. An expansion device for a rail configured for guidance of a vehicle wheel on a track, the expansion device comprising:

a plurality of components in the form of transverse strips to be installed on a portion of track in a spaced-apart relationship;

said transverse strips having a cross-section defined by a foot, a head, and a web extending between said foot and said head, said web being narrower than said foot and said head, and said cross-section being substantially identical with a cross-section of the rail to which said strips are to be mounted;

a plurality of compressible modules having a cross-section defined by a foot, a head, and a web extending between said foot and said head, said web being narrower than said foot and said head, and said compressible modules interspersed between said transverse strips for spacing said transverse strips in the spaced-apart relationship; and a plurality of shafts each extending through the transverse strips and the compressible modules.

2. The expansion device according to claim 1, wherein said compressible modules are elastomer elements or spring elements providing variable adjacent widths.

3. The expansion device according to claim 2, wherein said compressible elements have a width of approximately 10 mm in rest mode.

4. The expansion device according to claim 1, wherein said transverse strips are formed with at least one opening for an anti-friction component, and wherein a shaft is inserted in said opening and connects said transverse strips slidably in a longitudinal direction.

5. A rail for supporting and guiding a vehicle wheel on a track, comprising an expansion device according to claim 1.

6. The rail according to claim 5, which further comprises an anti-friction component at an end of a section of track and one of said shafts inserted in said anti-friction component, and wherein said transverse strips are formed with at least one opening for said anti-friction component and said shaft for connecting said rail to said transverse strips longitudinally by a slide.

7. The rail according to claim 5, configured as a railway rail adapted to guidance of an iron wheel.

8. The rail according to claim 5, configured as a flat track adapted to guidance of a pneumatic tire wheel.

9. The rail according to claim 5, configured as a traction rail adapted to guidance of one or two lateral wheels on said traction rail.

10. The rail according to claim 9, wherein said shafts comprise three shafts mounted at an end of a section of said traction rail and disposed to protrude through said transverse strips on either side and centrally in a top part of said traction rail and said transverse strips.

11. A rail installation process, which comprises:

removing a section of rail of a defined length from a track;

inserting a series of a plurality of transverse strips with compressible components in between and shafts extending there through in place of said section, wherein an expansion device is formed as defined in claim 1.

12. The expansion device according to claim 1, wherein said compressible modules prevent said transverse strips from directly contacting one another.

13. An expansion device for a rail configured for guidance of a vehicle wheel on a track, the expansion device comprising:

a plurality of components in the form of transverse strips to be installed on a portion of track;

said transverse strips having a constant cross-section defined by a foot, a head, and a web extending between said foot and said head, said web being narrower than said foot and said head, and said cross-section being substantially identical with a cross-section of the rail to which said strips are to be mounted; and a plurality of compressible modules having a cross-section defined by a foot, a head, and a web extending between said foot and said head, said web being narrower than said foot and said head, and said compressible modules interspersed between said transverse strips; and a plurality of shafts each extending through the transverse strips and the compressible modules.

14. An expansion device for a rail configured for guidance of a vehicle wheel on a track, the expansion device comprising:

a plurality of components in the form of transverse strips to be installed on a portion of track;

said transverse strips having a substantially uniform thickness and a cross-section defined by a foot, a head, and a web extending between said foot and said head, said web being narrower than said foot and said head, and said cross-section being substantially identical with a cross-section of the rail to which said strips are to be mounted; and a plurality of compressible modules having a cross section defined by a foot, a head, and a web extending between said foot and said head, said web being narrower than said foot and said head, and said compressible modules interspersed between said transverse strips; and a plurality of shafts each extending through the transverse strips and the compressible modules.

* * * * *